US007681654B1

(12) United States Patent
Cugnet

(10) Patent No.: US 7,681,654 B1
(45) Date of Patent: Mar. 23, 2010

(54) ISOLATING WELL BORE PORTIONS FOR FRACTURING AND THE LIKE

(76) Inventor: Matthew Cugnet, Box 1150, Weyburn (CA) S4H 2L5

( * ) Notice: Subject to any disclaimer, the term of this patent is extended or adjusted under 35 U.S.C. 154(b) by 0 days.

(21) Appl. No.: 12/533,610

(22) Filed: Jul. 31, 2009

(51) Int. Cl.
*E21B 33/12* (2006.01)

(52) U.S. Cl. ..... 166/387; 166/177.5; 166/308.1; 166/191

(58) Field of Classification Search ..... 166/191, 166/177.5, 308.1, 387, 313, 305.1, 147, 152
See application file for complete search history.

(56) References Cited

U.S. PATENT DOCUMENTS 5,058,673 A * 10/1991 Muller et al. ..... 166/187
5,782,306 A * 7/1998 Serafin ..... 166/387
6,253,856 B1 * 7/2001 Ingram et al. ..... 166/374
6,782,954 B2 8/2004 Serafin et al.
7,114,558 B2 * 10/2006 Hoffman et al. ..... 166/126
7,243,727 B2 7/2007 Tudor et al.
7,472,746 B2 * 1/2009 Maier ..... 166/129
2007/0051521 A1 * 3/2007 Fike et al. ..... 166/387

OTHER PUBLICATIONS

StackFRAC® Multi-Stage Fracturing Systems, Packers Plus, http://www.packersplus.com/pdfs/Products/StackFracBroch%200818reg.pdf.

* cited by examiner

*Primary Examiner*—David J Bagnell
*Assistant Examiner*—Blake Michener
(74) *Attorney, Agent, or Firm*—Frost Brown Todd LLC

(57) ABSTRACT

An apparatus and method for isolating a portion of a well bore and providing pressurized fluid thereto includes an upper packer, a lower packer, and a sliding sleeve between them. A seat is defined at the open bottom end of the lower sleeve and a sealing element is configured to seal the seat. A bias force urges the sliding sleeve toward a closed position. The apparatus moves along the bore and the lower packer is set at a desired location, and then an opening force is exerted on the tubing to move the sliding sleeve to the open position. After the lower packer is set and the sliding sleeve is open, the upper packer is set to isolate a portion of the well bore between the packers with the sliding sleeve in the open position to provide a flow path from the tubing string to the formation between the packers.

22 Claims, 2 Drawing Sheets

ISOLATING WELL BORE PORTIONS FOR FRACTURING AND THE LIKE

PRIORITY

This application claims priority to and benefit of Canadian Application

Serial No. 2,654,447, filed on Feb. 17, 2009, which is herein incorporated by reference in its entirety.

FIELD

This invention is in the field of horizontal wells for hydrocarbons and in particular fracturing such wells to increase production in the wells.

BACKGROUND

Conventionally, wells for oil and gas recovery are substantially vertical. A well bore is drilled from the surface to a position below a desired hydrocarbon containing formation, and then a casing, basically a steel pipe with a diameter just slightly smaller than the well bore, is placed inside the walls of the well bore and cemented into place. The walls of the casing that are located within the desired formation are perforated, and then the formation is fractured by pumping sand or a like proppant into the cased hole at high pressure. The pressurized proppant enters the formation through the perforations in the casing and breaks the formation with a series of fractures that expand as additional sand is pumped. After the formation is fractured, the resultant fractures act as permeable pathways allowing oil or gas to flow from the formation into the wellbore.

In contrast in a horizontal well, the well bore is drilled downward to the formation, and then turns to extend more or less horizontally through the formation. When drilling horizontal wells, coiled tubing is used where has the tubing as one continuous string coiled around a drum that reels pipe in or out to reach the desired depth, unlike conventional tubing where nine meter long lengths of pipe are screwed together as needed to position the tool at the bottom of the string at the desired location. Conventional tubing has the ability to rotate, such as to rotate a drill bit at the bottom of the tubing string, whereas coiled tubing cannot rotate, as it is anchored to the reel. The coiled tubing can bend to the required horizontal orientation to drill horizontally however, and typically the drilling bit is driven by a separate motor at the bottom end of the tubing driven by electric or hydraulic power. In a horizontal well, only the vertical portion of the well has a casing installed, and the horizontal well bore is left bare, comprising simply an open hole through the formation. Thus casing perforations are not required Since rock formations, including hydrocarbon formations, are typically laid down in more or less horizontal layers, conventional vertical wells were fractured at one location only, where they passed through the formation. Horizontal wells have the significant advantage of extending for long distances through the formation. Thus production can generally speaking be increased by fracturing the formation at as many locations as possible along the length of the well bore that is located in the formation.

To attain additional fractures after the initial fracture, the initial fracture must be isolated to prevent the pressurized proppant from simply entering and enlarging the initial fracture. Thus the initial fracture is made at the farthest or deepest end of the horizontal well bore, and then that initial fracture is isolated by various mechanical, fluid, hydraulic, or cement barriers such that pressurized proppant can be pumped into the well bore to create a new fracture on the upper side of the initial fracture. This process is repeated along the horizontal length of the well bore until a number fractures have been made along the horizontal length of the well bore from the initial fracture at the deepest ends to a final fracture at the shallow end of the horizontal well bore.

The present systems for isolating prior fractures typically increase cost, pumping time, and complexity, and as well only a limited number of fractures can be placed.

In one system, used by Packers Plus of Calgary, Canada, a liner is placed in the horizontal well bore. The liner includes a series of 10-12 ball seats that progressively increase in size from the deepest to the shallowest end of the liner. Covered ports are defined in the walls of the liner at intervals between the ball seats, and the covers are designed to rupture at a progressively increasing pressures from the deepest to the shallowest end of the liner. Packers are positioned on the outside of the liner adjacent to each ball seat to seal off the liner to the open well bore to isolate each zone.

Thus in the Packers Plus system, the initial fracture is made by pushing a small diameter ball down the liner to seat in the farthest ball seat and seal the end of the liner. Proppant is then pumped into the liner and the pressure is increased until the covers of the ports between the farthest ball seat and the next adjacent ball seat rupture, allowing the proppant to form a fracture in the formation through the farthest ports. For example this initial rupture pressure might be 1000 pounds per square inch (psi), and the fracture made at these ports is limited to the fracture that can be made with a pressure of 1000 psi, since increasing the pressure above this may cause the next adjacent ports to rupture.

Once the initial fracture has been made, a slightly larger ball is pushed down the liner to seat in the next adjacent ball seat, sealing off and isolating the first fracture. Pressure is increased to that sufficient to rupture the covers on the next adjacent ports, for example 1200 psi, and the second fracture is made creating whatever fracture can be made with this slightly increased pressure of 1200 psi. This process is repeated until all the available ports have been ruptured and fractures made through them. When all fractures have been made, the intermediate balls are typically pushed up to the surface by the production flowing from the fractures, with the farthest ball remaining in place sealing the end of the liner. The liner with the ball seats is left in the well which complicates future well repair and re-working. This system is currently popular as it is effective at preventing communication between fractures.

A system used by Baker Hughes of Houston Tex. utilizes a permanent liner and ball seats similar to Packers Plus except it has sliding sleeves or trap doors that are opened when a fracture is required and then sealed and isolated with progressively larger balls. This system currently is capable of about 14 separate fractures. When the fracturing is complete the liner is again left in the hole.

Other systems are known that utilize a coiled tubing assembly. Once an initial fracture is completed, a gel (viscous silicone) plug is pumped down the well bore and allowed to harden to isolate the first fracture from later ones. After fracturing is completed, the gel plugs are drilled out leaving the wellbore open to future repairs and enhanced recovery. This system was initially popular but has been found to allow communication between fractures since the gel plugs do not seal well enough to resist the high pressures, often 3000 psi or more, of a fracturing operation.

It is also known to pump in cement to form the plugs instead of gel. The cement is allowed to harden, then a fracture is made, then a new plug, then fracturing, and so on. This system's main drawback is the time required for the cement to harden sufficiently. With a conventional fracturing operation costing thousands of dollars an hour, this is not economically feasible on any but the most productive wells.

It is also commonly required to isolate portions of a well bore for other well stimulation methods such as acidizing, swabbing, sandjetting, brazing, and the like. A system for isolating a portion of a well bore between upper and lower packers and providing fluid to the isolated portion is disclosed in U.S. Pat. No. 6,782,954 to Serafin et al. In the system a sliding sleeve is provided by a mandrel and housing between the upper and lower packers, and a bypass is provided through the sleeve from the well bore below the lower packer to the well bore above the upper packer. The upper and lower packers are activated and set by a first pressure and then a second increased pressure opens ports in the sliding sleeve in the isolated zone between the packers. The system includes springs, catches, fingers, and other moving parts which react to changes in pressure to move the housing relative to the mandrel to open and close the ports in the sliding sleeve.

SUMMARY OF THE INVENTION

It is an object of the present invention to provide a system and method for fracturing formations in hydrocarbon wells that overcomes problems in the prior art.

In a first embodiment the present invention provides an apparatus for isolating a portion of an open horizontal well bore and for providing pressurized fluid to the isolated well portion. The apparatus comprises an upper packer adapted for attachment to a bottom end of a tubing string. A sliding sleeve comprises an upper sleeve telescopically engaged with a lower sleeve, where the upper sleeve is connected at a top end thereof to the upper packer and to the bottom end of an attached tubing string, and the lower sleeve is connected at a lower portion thereof to a lower packer such that a bottom end of the lower sleeve below the lower packer is open. A ball seat is defined at the bottom end of the lower sleeve, and a ball is configured to pass down through an attached tubing string and through the upper and lower sleeves to seal the bottom end of the lower sleeve. The upper and lower sleeves define sleeve ports that are in alignment to provide a flow path through the upper and lower sleeves when the sliding sleeve is in an open position, and wherein the sleeve ports are out of alignment to prevent flow through the upper and lower sleeves when the sliding sleeve is in a closed position. A bias element is operative to exert a bias force on the upper and lower sleeves urging the sliding sleeve toward the closed position. The upper and lower packers are configured such that same can be collapsed to allow same to be moved along the well bore by an attached tubing string, and such that the lower packer can be set to seal the well bore when the lower packer is at a desired location. After the lower packer is set, an opening force can be exerted through the tubing string on the sliding sleeve to move the sliding sleeve to the open position against the bias force. The upper and lower packers are configured such that, after the lower packer is set and the sliding sleeve is in the open position, the upper packer can be set to seal the well bore and isolate a portion of the well bore between the upper and lower packers with the sliding sleeve in the open position.

In a second embodiment the present invention provides an apparatus for isolating a portion of an open horizontal well bore and for providing pressurized fluid to the isolated well portion. The apparatus comprises an upper packer attached to a bottom end of a coiled tubing string. A sliding sleeve comprises an upper sleeve telescopically engaged with a lower sleeve, and the upper sleeve is connected at a top end thereof to the upper packer and to the bottom end of the coiled tubing string, and the lower sleeve is connected at a lower portion thereof to a lower packer such that a bottom end of the lower sleeve below the lower packer is open. A ball seat is defined at the bottom end of the lower sleeve, and a ball is configured to pass down through the coiled tubing string and through the upper and lower sleeves to seal the bottom end of the lower sleeve. The upper and lower sleeves define sleeve ports that are in alignment to provide a flow path through the upper and lower sleeves when the sliding sleeve is in an open position, and wherein the sleeve ports are out of alignment to prevent flow through the upper and lower sleeves when the sliding sleeve is in a closed position. A bias element is operative to exert a bias force on the upper and lower sleeves urging the sliding sleeve toward the closed position. The upper and lower packers are configured such that same can be collapsed to allow same to be moved along the well bore by the coiled tubing string, and such that the lower packer can be set to seal the well bore when the lower packer is at a desired location. After the lower packer is set, an opening force can be exerted through the coiled tubing string on the sliding sleeve to move the sliding sleeve to the open position against the bias force. The upper and lower packers are configured such that, after the lower packer is set and the sliding sleeve is in the open position, the upper packer can be set to seal the well bore and isolate a portion of the well bore between the upper and lower packers with the sliding sleeve in the open position.

In a third embodiment the present invention provides a method of isolating a portion of an open horizontal well bore and for providing pressurized fluid to the isolated well portion. The method comprises attaching an upper packer to a bottom end of a tubing string; providing a sliding sleeve comprising an upper sleeve telescopically engaged with a lower sleeve, and connecting a top end of the upper sleeve to the upper packer and to the bottom end of the tubing string, and connecting a lower portion of the lower sleeve to a lower packer such that a bottom end of the lower sleeve below the lower packer is open; providing a ball seat at the bottom end of the lower sleeve, and a ball configured to pass down through the tubing string and through the upper and lower sleeves to seal the ball seat; wherein the upper and lower sleeves define sleeve ports that are in alignment to provide a flow path through the upper and lower sleeves when the sliding sleeve is in an open position, and wherein the sleeve ports are out of alignment to prevent flow through the upper and lower sleeves when the sliding sleeve is in a closed position; providing a bias element operative to exert a bias force on the upper and lower sleeves urging the sliding sleeve toward the closed position; collapsing the upper and lower packers and circulating fluid through the tubing string and open bottom end of the lower sleeve and moving the packers along the well bore with the tubing string to locate the lower packer at a desired location; after the lower packer is at the desired location, pushing the ball through the tubing string and upper and lower sleeves to the ball seat to seal the bottom end of the lower sleeve; after the lower packer is at the desired location, setting the lower packer to seal the well bore at the desired location; after the lower packer is set, manipulating the tubing string to exert an opening force on the sliding sleeve to move the sliding sleeve to the open position against the bias force; after the lower packer is set and the sliding sleeve is in the open position, setting the upper packer to seal the well bore and isolate a portion of the well bore between the upper and lower packers; and pumping pressurized fluid through the tubing string and aligned sleeve ports to the isolated well portion.

The apparatus and method of the present invention allow placement of the isolated portion of the well bore virtually anywhere along the well bore while preventing communication between the current isolated portion and prior isolated portions of the well bore. The upper and lower packers are set in the open horizontal well bore with an open communication path from the tubing string to the desired formation location through the open sliding sleeve. The sliding sleeve is simple, with the only moving parts being a sliding relative movement between the upper and lower sleeves.

The invention allows quick placement of location with minimal time between each stage, and allows an unlimited number of locations, rather than being limited by liners as in the prior art. Circulation and well control through the tubing string are available if required, and in the event of being stuck in the hole by sand or the like, there are multiple ways to circulate the through the apparatus, washing the sand away, preventing it from becoming stuck and possibly anchored permanently down hole Operations require less time, and no costly sleeves or like equipment is permanently left in hole. When the process is complete, only an open hole remains, enabling future workovers using new technologies as they may become available, unlike prior art systems where future work is obstructed by liners and the like left in the well bore.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
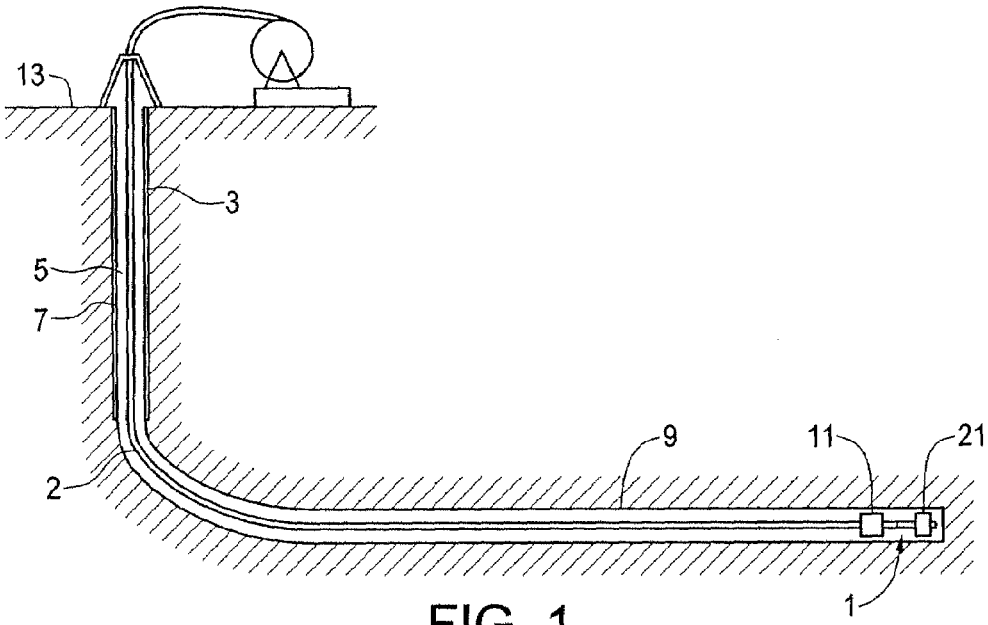
FIG. 1 is a schematic sectional side view showing an embodiment of an apparatus of the present invention in a typical well such as would be drilled to recover hydrocarbons.
Figure 2:
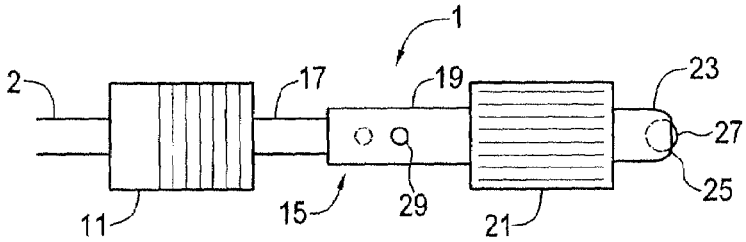
FIG. 2 is a schematic side view of the apparatus of FIG. 1.

FIGS. 1 and 2 schematically illustrate a side view of an embodiment of an apparatus 1 of the present invention for isolating a portion of an open horizontal well bore and for providing pressurized fluid to the isolated well portion. The apparatus 1 is illustrated in FIG. 1 attached to the bottom end of a coiled tubing string 2 in a typical horizontal well 3 such as is commonly drilled for recovering hydrocarbons such as oil and gas from underground formations. The well 3 comprises a generally vertical section of well bore 5 that is typically lined with a casing 7. The well 3 curves from vertical to horizontal when the desired formation is reached, and a section of horizontal well bore 9 extends through the formation. The horizontal well bore 9 is not cased, but rather is what is commonly referred to as an open hole or open well bore. Thus the bare formation is exposed along the length of the horizontal well bore 9.

Typically once the well 3 has been drilled and the vertical portion cased, the well will be completed by carrying out a well completion process such as fracturing the formation to allow hydrocarbons to more easily pass from the formation into the well. In horizontal wells the well bore is generally in the formation along its entire length, or most of its length, and so fracturing the formation at relatively close intervals is desirable. The present invention allows pressurized fluid for fracturing or like well completion or other processes, to be carried out at very close intervals, and unlike the systems of the prior art, with virtually no limit on the number of well portions that can be isolated and treated by fracturing or the like.

The apparatus 1 comprises an upper packer 11 attached to a bottom end of the coiled tubing string 2. Although the apparatus 1 is oriented horizontally when in use in the horizontal well bore 9, in this description terms such as "upper", "lower", "up", and "down" are used relative to the surface of the ground 13 at the top of the vertical well bore 5.

Figure 3:
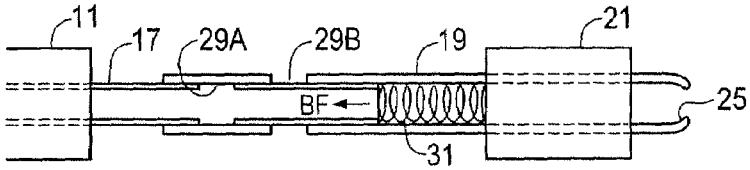
FIG. 3 is a schematic sectional side view of the sliding sleeve of the apparatus of FIG. 2 shown in the closed position.
Figure 4:
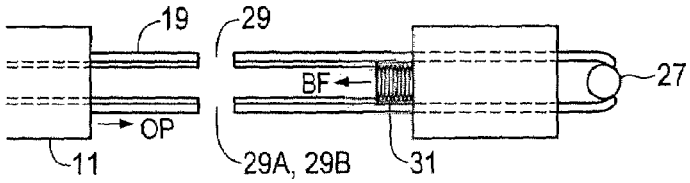
FIG. 4 is a schematic sectional side view of the sliding sleeve of the apparatus of FIG. 2 shown in the open position.

A sliding sleeve 15 comprises an upper sleeve 17 telescopically engaged with a lower sleeve 19. The upper sleeve 17 is connected at a top end thereof to the upper packer 11 and to the bottom end of the coiled tubing string 2, and the lower sleeve 19 is connected at a lower portion thereof to a lower packer 21 such that a bottom end 23 of the lower sleeve 19 is below the lower packer 21, and is open, such that fluid can circulate through the coiled tubing string 2 and sliding sleeve 15 and then out the open bottom end 23 of the lower sleeve 19. As illustrated in FIGS. 3 and 4, the upper and lower sleeves 17, 19 are shown extending through the corresponding upper and lower packers 11, 21. The actual construction may be otherwise, so long as fluid can freely communicate from the tubing string 2 out the open bottom end of the apparatus, shown as the bottom end 23 of the lower sleeve 19.

A seat provided by ball seat 25 is defined at the bottom end 23 of the lower sleeve 19, and a sealing element, provided by ball 27 is configured to be able to pass down through the coiled tubing string 2 and through the upper and lower sleeves 17, 19 to seal the bottom end 23 of the lower sleeve 19. Alternatively as is known in the art the sealing element can be provided by an elongate dart shaped body that will move down the tubing string without tumbling, and which has a tapered or rounded bottom end that is configured to provide a seal when in contact with the seat. Such a sealing element or ball 27 is also commonly configured to collapse at pressures above those contemplated to be used in a particular operation so that, should the need arise, pressure in the tubing string can be increased to blow the sealing element out the end of the lower sleeve in order to allow circulation through the open bottom end of the tubing string at the open bottom end 23 of the lower sleeve 19 the sealing element.

The upper and lower sleeves 17, 19 define sleeve ports 29 that are in alignment to provide a flow path through the upper and lower sleeves 17, 19 when the sliding sleeve 15 is in an open position as illustrated in FIG. 4 where the sleeve port 29A in the upper sleeve 17 is aligned with the sleeve port 29B in the lower sleeve 19. The sleeve ports 29A, 29B are out of alignment to prevent flow through the upper and lower sleeves 17, 19 when the sliding sleeve 15 is in the closed position illustrated in FIG. 3.

A bias element, illustrated as a spring 31, is operative to exert a bias force BF on the upper and lower sleeves 17, 19 urging the sliding sleeve 15 toward the closed position. In the illustrated embodiment of FIGS. 3 and 4, the bias force BF is exerted upward, or toward the surface, to urge the upper sleeve 17 upward relative to the lower sleeve 19.

The upper and lower packers 11, 21 are configured such that same can be collapsed to allow same to be moved along the well bore 9 by the coiled tubing string 2, and such that the lower packer 21 can be set to seal the well bore 9 when the lower packer 11 is at a desired location. Conveniently the lower packer 21 is provided by a hydraulic packer of the type that is operative to expand and set in response to pressurized fluid directed through the coiled tubing string 2 and into the lower sleeve 19 after the ball 27 is in the ball seat 27 to prevent the fluid from simply passing out the open end 23 of the lower sleeve 19.

After the lower packer 21 is set, the lower packer is fixed in the well bore 9 so that an opening force OP can be exerted through the coiled tubing string 2 on the sliding sleeve, such as by releasing some of the weight of the vertical portion of the tubing string 2 such that the tubing string moves down exerting an opening force OP that is greater than the bias force BF and so is sufficient to move the sliding sleeve 15 to the open position of FIG. 4 against the bias force BF provided by the spring 31.

After the lower packer 21 is set and fixed in the well bore 9, and the sliding sleeve 15 is in the open position, the upper packer 11 can be set to seal the well bore 9 and isolate that portion of the well bore 9 that is between the upper and lower packers 11, 21. Conveniently the upper packer 11 is provided by a compression packer that is set by releasing a further weight of the tubing string 2 sufficient to exert a downward setting force on the compression packer. The compression packer is set by the weight of the tubing forcing the top of the packer downward while the bottom of the packer is fixed in place by the set lower packer 21 and the fully collapsed sliding sleeve 15.

The setting force required to set the upper compression type packer 11 is greater than the opening force OP that is required to overcome the bias force to open the sliding sleeve 15. Thus the sliding sleeve 15 will move to the open position before the upper packer 11 sets. When using the compression type upper packer 11, the sliding sleeve 15 must be in the open position before the upper packer 11 is set, since once the upper packer 11 is set, no movement of the sliding sleeve to the open position is possible.

Once the upper and lower packers are set, the portion of the well bore 9 that is between the upper and lower packers 11, 21 is isolated from the rest of the well bore 9 and pressurized fluid for well stimulation by fracturing or acidizing the formation at the isolated location, or for other purposes, can be provided down the tubing string 2 and through the aligned sleeve ports 29.

Thus a method of the present invention for isolating a portion of an open horizontal well bore and for providing pressurized fluid to the isolated well portion comprises attaching an upper packer 11 to a bottom end of a tubing string 2; providing a sliding sleeve 15 comprising an upper sleeve 17 telescopically engaged with a lower sleeve 19, and connecting a top end of the upper sleeve 17 to the upper packer 11 and to the bottom end of the tubing string 2, and connecting a lower portion of the lower sleeve 19 to a lower packer 21 such that a bottom end 23 of the lower sleeve 9 is below the lower packer 21 is open; providing a ball seat 25 at the bottom end 23 of the lower sleeve 19, and a ball 27 configured to pass down through the tubing string 2 and through the upper and lower sleeves 17, 19 to seal the ball seat 25. The upper and lower sleeves 17, 19 define sleeve ports 29 that are in alignment to provide a flow path through the upper and lower sleeves 17, 19 when the sliding sleeve 15 is in an open position such as illustrated in FIG. 4, and wherein the sleeve ports 29 are out of alignment to prevent flow through the upper and lower sleeves 17, 19 when the sliding sleeve 15 is in the closed position shown in FIG. 3. A bias element such as a spring 31 is operative to exert a bias force BF on the upper and lower sleeves 17, 19 urging the sliding sleeve 15 toward the closed position.

The method then includes collapsing the upper and lower packers 11, 21 and circulating fluid through the tubing string 2 and open bottom end 23 of the lower sleeve 19 and moving the packers 11, 21 along the well bore 9 with the tubing string 2 to locate the lower packer 21 at a desired location, and after the lower packer 21 is at the desired location, pushing the ball 27 through the tubing string 2 and upper and lower sleeves 17, 19 to the ball seat 25 to seal the bottom end 23 of the lower sleeve 19, and after the lower packer 21 is at the desired location, setting the lower packer 21 to seal the well bore 9 at the desired location.

The hydraulic lower packer 21 is set by pressurized fluid pumped into the tubing string 2 and through the sliding sleeve 15 which is in the closed position and into the hydraulic lower packer 21, since the ball seat at the bottom end 23 of the lower sleeve 19 is sealed by the ball 27. Typically the fluid enters the hydraulic packer through a one way valve and the hydraulic packer which expands in response to the pressure.

The method then includes, after the lower packer 21 is set, manipulating the tubing string 2 to exert an opening force OP on the sliding sleeve 15 to move the sliding sleeve 15 to the open position of FIG. 4 against the bias force BF, and after the lower packer 21 is set, setting the upper packer 11 to seal the well bore 9 and isolate a portion of the well bore 9 between the upper and lower packers 11, 21. Pressurized fluid is then pumped through the tubing string 2 and out through the aligned sleeve ports 29 to the isolated well portion. Using the hydraulically activated lower pack 21 as described above, requires that the ball 27 be pushed through the tubing string 2 and upper and lower sleeves 17, 19 to the ball seat 25 prior to setting the lower packer 21 so that pressurized fluid pumped down the tubing string 2 can exert pressure on the lower packer 21 to set the packer rather than escaping out the open bottom end 23 of the lower sleeve 19.

When using the illustrated apparatus 1, the opening force OP is exerted in a downward direction by releasing a weight of the tubing string 2 sufficient to overcome the bias force BF to move the sliding sleeve 15 downward to the open position. As the tubing string 2 moves down the sliding sleeve 15 opens, allowing some circulation through the aligned sleeve ports 29 and the surface through the annulus between the walls of the well bore 9 on the outside of the tubing string 2. This allows water to be pumped into the well bore 9, conditioning the hole, and, for example in a fracturing operation, allowing the proppant to be circulated down the tubing string to arrive at the desired working location when needed. Once the sliding sleeve is open, and any desired circulation through the annulus is complete, further weight from the tubing string 2 can be allowed to exert a downward setting force, greater than the opening force OP, on the compression packer that is required to set the upper compression type packer 21.

Figure 5:
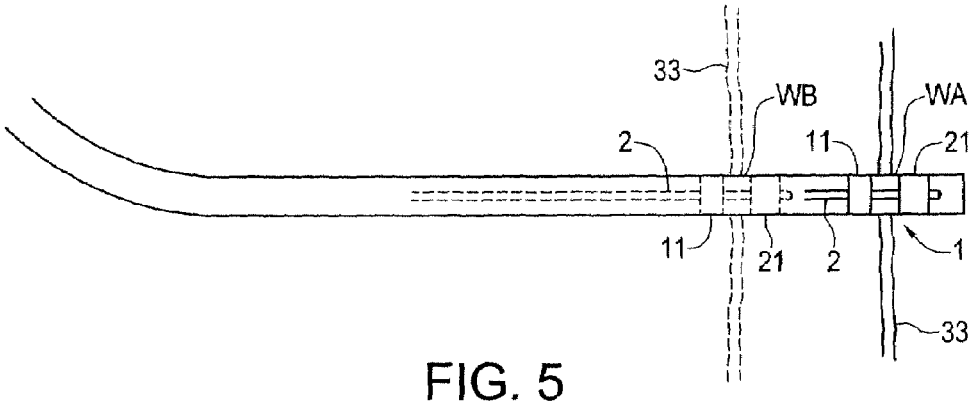
FIG. 5 is a schematic sectional side view showing the apparatus of FIG. 1 in a typical well in a first location to isolate a first portion of the well bore, and in a second location shown in phantom lines to isolate a second portion of the well bore.

As schematically illustrated in FIG. 5, once the desired operation, such as making fractures 33 in the formation, has been completed at a first isolated portion WA of the well bore 9, the upper and lower packers 11, 21 are collapsed and the tubing string 2 is moved to locate the lower packer 21 at a second desired location in the well bore 9. Generally in practice the operations will be performed first at the deepest end of the well bore 9 moving toward the top end of the well bore 9 so that the coiled tubing string 2 can pull the apparatus 1 back out of the hole and leave the operated portions of the well bore 9 behind. Thus generally the second desired location will be nearer to the surface of the well 3 than the first isolated portion WA.

The compression type upper packer 11 is collapsed by exerting an upward force on the coiled tubing string 2. Once the upper packer 11 is collapsed, the upper packer 11 will begin moving upward in response to continued upward force and the sliding sleeve 15 will move to the closed position as the upper sleeve moves upward with the upper packer 11. When the sliding sleeve 15 is fully extended, the upward force of the tubing string 2 will then be transferred to the lower hydraulic packer 21 and will open the one way valve to release the pressurized fluid trapped therein, and collapse the hydraulic lower packer 21. By starting operations at the deepest desired location, further upward force on the tubing string 2 then pulls the apparatus 1 to the next desired location.

When the lower packer 21 is at the second desired location, shown in phantom lines, the lower packer 21 is again set to seal the well bore 9 at the second desired location, and the tubing string 2 is lowered to open the sliding sleeve 15 and set the upper packer 11 to seal the well bore and isolate a second portion WB of the well bore 9 between the upper and lower packers 17, 19, and pressurized fluid is pumped through the tubing string 2 and aligned sleeve ports 29 to the second isolated well portion WB to make further fractures 33.

In most operations the ball 27 can be left in the seat 25 when moving the apparatus 1 from a one location to the next, however should the apparatus 1 and packers 11, 21 become stuck in the well bore 9, the ball 27 can be circulated out of the seat 25 by drawing fluid upward through the tubing string 2, moving the ball 27 out of the tubing string 2, and then circulating fluid through the open bottom end 23 of the lower sleeve 19 to clear the well bore 9, or if necessary by increasing the pressure to collapse the ball 27 and blow same out the end 23 of the lower sleeve 19 to allow circulation.

Figure 6:
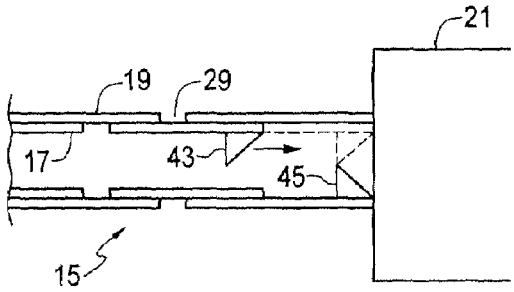
FIGS. 6 and 7 schematically illustrate embodiments of the invention that include valve mechanisms operative to close off the lower packer to substantially prevent fluid communication between the sliding sleeve and the lower packer when the sliding sleeve is in the open position.
Figure 7:
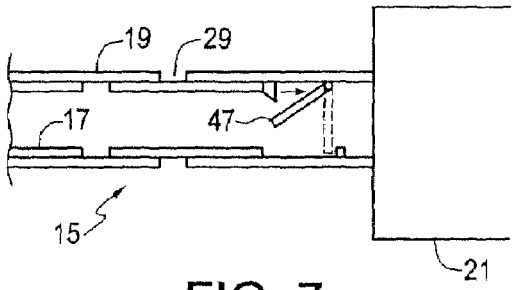

FIGS. 6 and 7 schematically illustrate embodiments of the invention that include a valve mechanism operative to close off the lower packer 21 to substantially prevent fluid communication between the sliding sleeve 15 and the lower packer 21 when the sliding sleeve 15 is in the open position. Such a valve mechanism prevents the lower packer 21 from being subjected to abrasive fluids and the high pressures during a fracturing operation.

In the embodiment of FIG. 6, the valve mechanism comprises a first valve sealing portion 43 mounted to the upper sleeve 17 and a second valve sealing portion 45 mounted to the lower sleeve 19 such that when the sliding sleeve 15 moves to the open position where the sleeve ports 29 are aligned, the first and second valve sealing portions 43, 45 mate to seal off the lower packer 21 from fluid and pressure in the sliding sleeve 15.

Similarly in the embodiment of FIG. 7 the valve mechanism comprises a valve flap 47 biased to an open position and then pushed to a closed position as the upper sleeve 17 moves down into the lower sleeve 19 and the sliding sleeve 15 moves to the open position where the sleeve ports 29 are aligned.

In both embodiments as the sliding sleeve 15 moves to the closed position, the valve mechanism opens to allow fluid communication. It is contemplated that numerous other valve mechanisms known in the art would serve the purpose as well.

The apparatus and method of the present invention allows placement of the isolated portion of the well bore virtually anywhere along the well bore while preventing communication between the current isolated portion and prior isolated portions of the well bore. The invention allows quick placement of location with minimal time between each stage, and allows an unlimited number of locations, rather than being limited by liners as in the prior art.

Beneficially the ball and seat arrangement allows circulation/well control through the tubing string should the formation begin flowing uncontrolled, and allows well control during a fracturing process. In the event of 'sanding off' or being stuck in sand, there are multiple ways to circulate the through the apparatus, washing the sand away, preventing it from becoming stuck and possibly anchored permanently down hole Circulation of varying amounts is possible in the apparatus, as well as out the bottom of the apparatus.

Operations require less time, and no costly sleeves or like equipment is permanently left in hole. When the process is complete, only an open hole remains, enabling future workovers using new technologies as they may become available, unlike prior art systems where future work is obstructed by liners and the like left in the well bore.

The present invention may be used for well stimulation methods such as fracturing, acidizing, and the like.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. An apparatus for isolating a portion of an open horizontal well bore and for providing pressurized fluid to the isolated well portion, the apparatus comprising:

an upper packer adapted for attachment to a bottom end of a tubing string;

a sliding sleeve comprising an upper sleeve telescopically engaged with a lower sleeve, and where the upper sleeve is connected at a top end thereof to the upper packer and to the bottom end of an attached tubing string, and the lower sleeve is connected at a lower portion thereof to a lower packer such that a bottom end of the lower sleeve below the lower packer is open;

a seat at the bottom end of the lower sleeve, and a sealing element configured to pass down through an attached tubing string and through the upper and lower sleeves to seal the bottom end of the lower sleeve;

wherein the upper and lower sleeves define sleeve ports that are in alignment to provide a flow path through the upper and lower sleeves when the sliding sleeve is in an open position, and wherein the sleeve ports are out of alignment to prevent flow through the upper and lower sleeves when the sliding sleeve is in a closed position;

a bias element operative to exert a bias force on the upper and lower sleeves urging the sliding sleeve toward the closed position;

wherein the upper and lower packers are configured such that the same can be collapsed to allow the same to be moved along the well bore by an attached tubing string, and such that the lower packer can be set to seal the well bore when the lower packer is at a desired location;

wherein, after the lower packer is set, an opening force can be exerted through the tubing string on the sliding sleeve to move the sliding sleeve to the open position against the bias force; and wherein the upper and lower packers are configured such that, after the lower packer is set and the sliding sleeve is in the open position, the upper packer can be set to seal the well bore and isolate a portion of the well bore between the upper and lower packers with the sliding sleeve in the open position.

2. The apparatus of claim 1 wherein the lower packer is provided by a hydraulic packer operative to expand in response to pressurized fluid directed through an attached tubing string and into the lower sleeve after the sealing element is in the seat.

3. The apparatus of claim 2 wherein the bias force is exerted upward to urge the upper sleeve upward relative to the lower sleeve, and wherein the opening force is exerted in a downward direction by releasing a weight of the tubing string sufficient to overcome the bias force to move the sliding sleeve downward to the open position.

4. The apparatus of claim 3 wherein the upper packer is provided by a compression packer that is set by releasing a weight of the tubing string sufficient to exert a downward setting force on the compression packer, and wherein the setting force is greater than the opening force that is required to overcome the bias force.

5. The apparatus of claim 2 further comprising a valve mechanism operative to close off the lower packer to substantially prevent fluid communication between the sliding sleeve and the lower packer when the sliding sleeve is in the open position.

6. The apparatus of claim 1 wherein the pressurized fluid comprises fluid for well stimulation by one of fracturing and acidizing a formation.

7. An apparatus for isolating a portion of an open horizontal well bore and for providing pressurized fluid to the isolated well portion, the apparatus comprising:

an upper packer attached to a bottom end of a coiled tubing string;

a sliding sleeve comprising an upper sleeve telescopically engaged with a lower sleeve, and where the upper sleeve is connected at a top end thereof to the upper packer and to the bottom end of the coiled tubing string, and the lower sleeve is connected at a lower portion thereof to a lower packer such that a bottom end of the lower sleeve below the lower packer is open;

a seat at the bottom end of the lower sleeve, and a sealing element configured to pass down through the coiled tubing string and through the upper and lower sleeves to seal the bottom end of the lower sleeve;

wherein the upper and lower sleeves define sleeve ports that are in alignment to provide a flow path through the upper and lower sleeves when the sliding sleeve is in an open position, and wherein the sleeve ports are out of alignment to prevent flow through the upper and lower sleeves when the sliding sleeve is in a closed position;

a bias element operative to exert a bias force on the upper and lower sleeves urging the sliding sleeve toward the closed position;

wherein the upper and lower packers are configured such that the same can be collapsed to allow the same to be moved along the well bore by the coiled tubing string and such that the lower packer can be set to seal the well bore when the lower packer is at a desired location;

wherein, after the lower packer is set, an opening force can be exerted through the coiled tubing string on the sliding sleeve to move the sliding sleeve to the open position against the bias force; and wherein the upper and lower packers are configured such that, after the lower packer is set and the sliding sleeve is in the open position, the upper packer can be set to seal the well bore and isolate a portion of the well bore between the upper and lower packers with the sliding sleeve in the open position.

8. The apparatus of claim 7 wherein the lower packer is provided by a hydraulic packer operative to expand in response to pressurized fluid directed through an attached tubing string and into the lower sleeve after the sealing element is in the seat.

9. The apparatus of claim 8 wherein the bias force is exerted upward to urge the upper sleeve upward relative to the lower sleeve, and wherein the opening force is exerted in a downward direction by releasing a weight of the tubing string sufficient to overcome the bias force to move the sliding sleeve downward to the open position.

10. The apparatus of claim 9 wherein the upper packer is provided by a compression packer that is set by releasing a weight of the tubing string sufficient to exert a downward setting force on the compression packer, and wherein the setting force is greater than the opening force that is required to overcome the bias force.

11. The apparatus of claim 7 further comprising a valve mechanism operative to close off the lower packer to substantially prevent fluid communication between the sliding sleeve and the lower packer when the sliding sleeve is in the open position.

12. The apparatus of claim 7 wherein the pressurized fluid comprises fluid for well stimulation by one of fracturing and acidizing a formation.

13. A method of isolating a portion of an open horizontal well bore and for providing pressurized fluid to the isolated well portion, the method comprising:

attaching an upper packer to a bottom end of a tubing string;

providing a sliding sleeve comprising an upper sleeve telescopically engaged with a lower sleeve, and connecting a top end of the upper sleeve to the upper packer and to the bottom end of the tubing string, and connecting a lower portion of the lower sleeve to a lower packer such that a bottom end of the lower sleeve below the lower packer is open;

providing a seat at the bottom end of the lower sleeve, and a sealing element configured to pass down through the tubing string and through the upper and lower sleeves to seal the seat;

wherein the upper and lower sleeves define sleeve ports that are in alignment to provide a flow path through the upper and lower sleeves when the sliding sleeve is in an open position, and wherein the sleeve ports are out of alignment to prevent flow through the upper and lower sleeves when the sliding sleeve is in a closed position;

providing a bias element operative to exert a bias force on the upper and lower sleeves urging the sliding sleeve toward the closed position;

collapsing the upper and lower packers and circulating fluid through the tubing string and open bottom end of the lower sleeve and moving the packers along the well bore with the tubing string to locate the lower packer at a desired location;

pushing the sealing element through the tubing string and upper and lower sleeves to the seat to seal the bottom end of the lower sleeve;

after the lower packer is at the desired location, setting the lower packer to seal the well bore at the desired location;

after the lower packer is set, manipulating the tubing string to exert an opening force on the sliding sleeve to move the sliding sleeve to the open position against the bias force;

after the lower packer is set and the sliding sleeve is in the open position, setting the upper packer to seal the well bore and isolate a portion of the well bore between the upper and lower packers; and pumping pressurized fluid through the tubing string and aligned sleeve ports to the isolated well portion.

14. The method of claim 13 wherein the sealing element is pushed through the tubing string and upper and lower sleeves to the seat prior to setting the lower packer.

15. The method of claim 14 wherein the lower packer is provided by a hydraulic packer and comprising pumping pressurized fluid through the tubing string and the lower sleeve into the hydraulic packer to set the lower packer.

16. The method of claim 15 further comprising operating a valve mechanism to close off the lower packer to substantially prevent fluid communication between the sliding sleeve and the lower packer when the sliding sleeve is in the open position.

17. The method of claim 15 wherein the bias force is exerted upward to urge the upper sleeve upward relative to the lower sleeve, and comprising exerting the opening force in a downward direction by releasing a weight of the tubing string sufficient to overcome the bias force to move the sliding sleeve downward to the open position.

18. The method of claim 17 wherein the upper packer is provided by a compression packer that is set by exerting a downward setting force on the compression packer that is greater than the opening force that is required to overcome the bias force, and comprising, releasing a further weight of tubing to exert the setting force to set the upper packer.

19. The method of claim 13 further comprising:

collapsing the upper and lower packers at a first isolated portion of the well bore and moving the tubing string to locate the lower packer at a second desired location in the well bore;

after the lower packer is at the second desired location, setting the lower packer to seal the well bore at the second desired location;

after the lower packer is set, manipulating the tubing string to exert the opening force on the sliding sleeve to move the sliding sleeve to the open position against the bias force; and after the lower packer is set and the sliding sleeve is in the open position, setting the upper packer to seal the well bore and isolate a second portion of the well bore between the upper and lower packers; and pumping pressurized fluid through the tubing string and aligned sleeve ports to the second isolated well portion.

20. The method of claim 19 wherein the second desired location in the well bore is nearer to a surface of the well bore than the first isolated portion of the well bore.

21. The method of claim 19 comprising collapsing the upper packer by exerting an upward force on the coiled tubing string, wherein the upward force also moves the sliding sleeve to the closed position and collapses the lower packer.

22. The method of claim 21 further comprising, when packers become stuck in the well bore, circulating the sealing element out of the seat and up the tubing string, and then circulating fluid through the open bottom end of the lower sleeve to clear the well bore.

* * * * *